US007089830B2

(12) United States Patent
Hu

(10) Patent No.: US 7,089,830 B2
(45) Date of Patent: Aug. 15, 2006

(54) COMPACT WRENCH WITH THREE-STAGE CONTROL

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 52 days.

(21) Appl. No.: 10/999,287

(22) Filed: Nov. 29, 2004

(65) Prior Publication Data

US 2005/0257650 A1 Nov. 24, 2005

(30) Foreign Application Priority Data

May 19, 2004 (TW) ..... 93114044 A

(51) Int. Cl.
*B25B 13/46* (2006.01)

(52) U.S. Cl. ..... 81/63.1; 83/60; 83/61
(58) Field of Classification Search ..... 81/63.1, 81/60, 61, 62, 63.2
See application file for complete search history.

(56) References Cited

U.S. PATENT DOCUMENTS 5,467,672 A * 11/1995 Ashby ..... 81/58.2
6,467,378 B1 * 10/2002 Chen ..... 81/60
6,539,825 B1 * 4/2003 Lin ..... 81/60
6,584,875 B1 * 7/2003 Deng ..... 81/63.1
6,647,833 B1 * 11/2003 Wu ..... 81/63.2
6,964,216 B1 * 11/2005 Chen ..... 81/63.1
6,981,434 B1 * 1/2006 Chen ..... 81/63.1
6,988,429 B1 * 1/2006 Lee et al. ..... 81/63.2
2004/0083860 A1 * 5/2004 Arnold et al. ..... 81/63.2

FOREIGN PATENT DOCUMENTS

TW 519023 1/2003

* cited by examiner

*Primary Examiner*—Lee D. Wilson
*Assistant Examiner*—Alvin J. Grant
(74) *Attorney, Agent, or Firm*—Alan D. Kamrath; Nikolai & Mersereau, P.A.

(57) ABSTRACT

A wrench includes a handle, a head, a drive member rotatably mounted in the head, two pawls, an elastic element for biasing at least one of the pawls to engage with the drive member, and a pivotable switch. An end of each pawl defines a space. The end of each pawl further includes a protrusion. The spaces of the pawls overlap with each other and the protrusion of each pawl is located in the space of the other pawl. The switch includes an actuating member extending into the overlapped spaces of the pawls and between the protrusions of the pawls. The actuating member of the switch is pivotable to engage with and thus move the protrusion of one of the pawls, disengaging the pawl from the drive member and thereby changing a driving rotation direction and a free rotation direction of the wrench.

35 Claims, 11 Drawing Sheets

COMPACT WRENCH WITH THREE-STAGE CONTROL

BACKGROUND OF THE INVENTION

1. Field of the Invention

The present invention relates to a compact wrench. In particular, the present invention relates to a compact wrench with three-stage control, allowing the wrench to be in one of three operating states.

2. Description of the Related Art

FIG. 11 of the drawings illustrates a conventional wrench comprising a handle 10' and a head 11' formed on an end of the handle 10'. The head 11' includes a compartment 12' in which a wheel 20' is rotatably mounted. Two pawls 30' are mounted in cavity 14' defined in the head 11' and communicated with the compartment 12'. Each pawl 30' includes a plurality of teeth 301' on a side thereof for releasably engaging with teeth 21' in an outer periphery of the wheel 20'. Each pawl 30' further includes a peg 302' on a lateral face thereof that faces the other pawl 30', with a spring 31' attached between the pegs 302' on the pawls 30'. Further, each pawl 30' includes a protrusion 303' formed on an upper side thereof and extending through a slot 15' into a control groove 13' in a side of the head 11'.

A switching disc 41' is pivotally mounted in the control groove 13' by a pin 43'. The protrusion 303' of each pawl 30' extends into a groove 412' in the switching disc 41', allowing the protrusion 303' of the pawl 30' to slide along the slot 15' when the switching disc 41' is turned. The switching disc 41' further includes two tubular members 411' each having a downward opening. A spring 44' is mounted in a hole 131' in a bottom wall delimiting the control groove 13'for biasing a ball 45' into one of the tubular members 411'. A thumb turn 42' is formed on top of the switching disc 41' to allow manual switching of the switching disc 41', allowing the ball 45' to selectively engage with one of the tubular members 411'. When the ball 45' is engaged one of the tubular member 411', one of the pawls 30' is engaged with the wheel 20' whereas the other pawl 30' is disengaged from the wheel 20', allowing driving rotation in a first direction and free rotation in a second direction reverse to the first direction. When the ball 45' is engaged with the other tubular member 411', the originally engaged pawl 30' is disengaged from the wheel 20' whereas the other pawl 30' is engaged with the wheel 20', allowing driving rotation in the second direction and free rotation in the first direction.

The head of the wrench has a relatively large size, as a large compartment 14' for receiving the pawls 30' is required. Further, the arrangement for switching the driving direction is complicated and thus takes a long time to manufacture and assemble. The cost of the wrench is thus high.

SUMMARY OF THE INVENTION

In accordance with an aspect of the present invention, a wrench comprises a handle, a head formed on an end of the handle, a drive member rotatably mounted in a compartment of the head, two pawls slidably mounted in a cavity defined in an inner periphery delimiting the compartment and communicated with a hole defined in a side of the handle; an elastic element mounted between the pawls for biasing teeth in a first end of each pawl to engage with teeth in an outer periphery of the drive member, and a switch pivotally mounted in the hole of the handle.

A second end of each pawl defines a space. The second end of each pawl further includes a protrusion. The pawls are so mounted that the spaces of the pawls overlap with each other and that the protrusion of each pawl is located in the space of the other pawl.

The switch includes an actuating member extending into the overlapped spaces of the pawls and between the protrusions of the pawls. The actuating member of the switch is pivotable to engage with and thus move the protrusion of one of the pawls, disengaging the teeth of the pawl from the teeth of the drive member and thereby changing a driving rotation direction and a free rotation direction of the wrench.

The switch is pivotable between three positions, and the switch is retained in one of the three positions. In an embodiment of the invention, an inner periphery delimiting the hole of the handle includes three retaining sections. The switch includes a receptacle for receiving a ball, and an elastic element biases the ball to engage with one of the three retaining sections.

In another embodiment of the invention, the switch includes three retaining sections. An inner periphery delimiting the hole of the handle includes a receptacle for receiving a ball. An elastic element biases the ball to engage with one of the three retaining sections.

One of the pawls is disengaged from the drive member and the other pawl is engaged with the drive member when the switch is in a first one of the three retaining sections, allowing clockwise driving rotation and counterclockwise free rotation of the wrench. Both of the pawls are engaged with the drive member when the switch in a second one of the three retaining sections, allowing driving rotation of the wrench in either direction. The pawl is engaged with the drive member and the other pawl is disengaged from the drive member when the switch is in a third one of the three retaining sections, allowing counterclockwise driving rotation and clockwise free rotation of the wrench.

In an embodiment of the invention, the outer periphery of the drive member includes an annular groove. The inner periphery delimiting the compartment includes an annular groove. A C-clip is partially received in the annular groove of the drive member and partially received in the annular groove of the compartment.

In an embodiment of the invention, each pawl includes a block and a platform extending from an end of a side of the block. Preferably, the platform of one of the pawls extends from a lower end of the block of one of the pawls, defining an upward facing space. The platform of the other pawl extends from an upper end of the side of the block of the other pawl, defining a downward facing space. The platforms face each other and are spaced from each other by the overlapped space of the pawls.

In accordance with another aspect of the invention, a wrench comprises a handle, a head formed on an end of the handle, a drive member rotatably mounted in a compartment of the head, two pawls slidably mounted in a cavity defined in an inner periphery delimiting the compartment and communicated with a hole defined in a side of the handle, an elastic element mounted between the pawls for biasing at least one of the pawls to engage with the drive member, and a switch pivotally mounted in the hole of the handle.

An end of each pawl defines a space. The end of each pawl further includes a protrusion. The pawls are so mounted that the spaces of the pawls overlap with each other and that the protrusion of each pawl is located in the space of the other pawl.

The switch includes an actuating member extending into the overlapped spaces of the pawls and between the protrusions of the pawls. The actuating member of the switch is pivotable to engage with and thus move the protrusion of one of the pawls, disengaging the pawl from the drive member and thereby changing a driving rotation direction and a free rotation direction of the wrench.

In accordance with a further aspect of the invention, a wrench comprises a handle, a head formed on an end of the handle, a drive member rotatably mounted in a compartment of the head, two pawls slidably mounted in a cavity defined in an inner periphery delimiting the compartment and communicated with a hole defined in a side of the handle, an elastic element for biasing at least one of the pawls to engage with the drive member, and a switch mounted in the hole of the handle and pivotable between three positions.

The switch includes an actuating member for urging a selected one of the pawls to disengage from the drive member, thereby changing a driving rotation direction and a free rotation direction of the wrench.

One of the pawls is disengaged from the drive member and the other pawl is engaged with the drive member when the switch is in a first one of the three positions, allowing clockwise driving rotation and counterclockwise free rotation of the wrench. Both of the pawls are engaged with the drive member when the switch in a second one of the three positions, allowing driving rotation of the wrench in either direction. The pawl is engaged with the drive member and the other pawl is disengaged from the drive member when the switch is in a third one of the three positions, allowing counterclockwise driving rotation and clockwise free rotation of the wrench.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
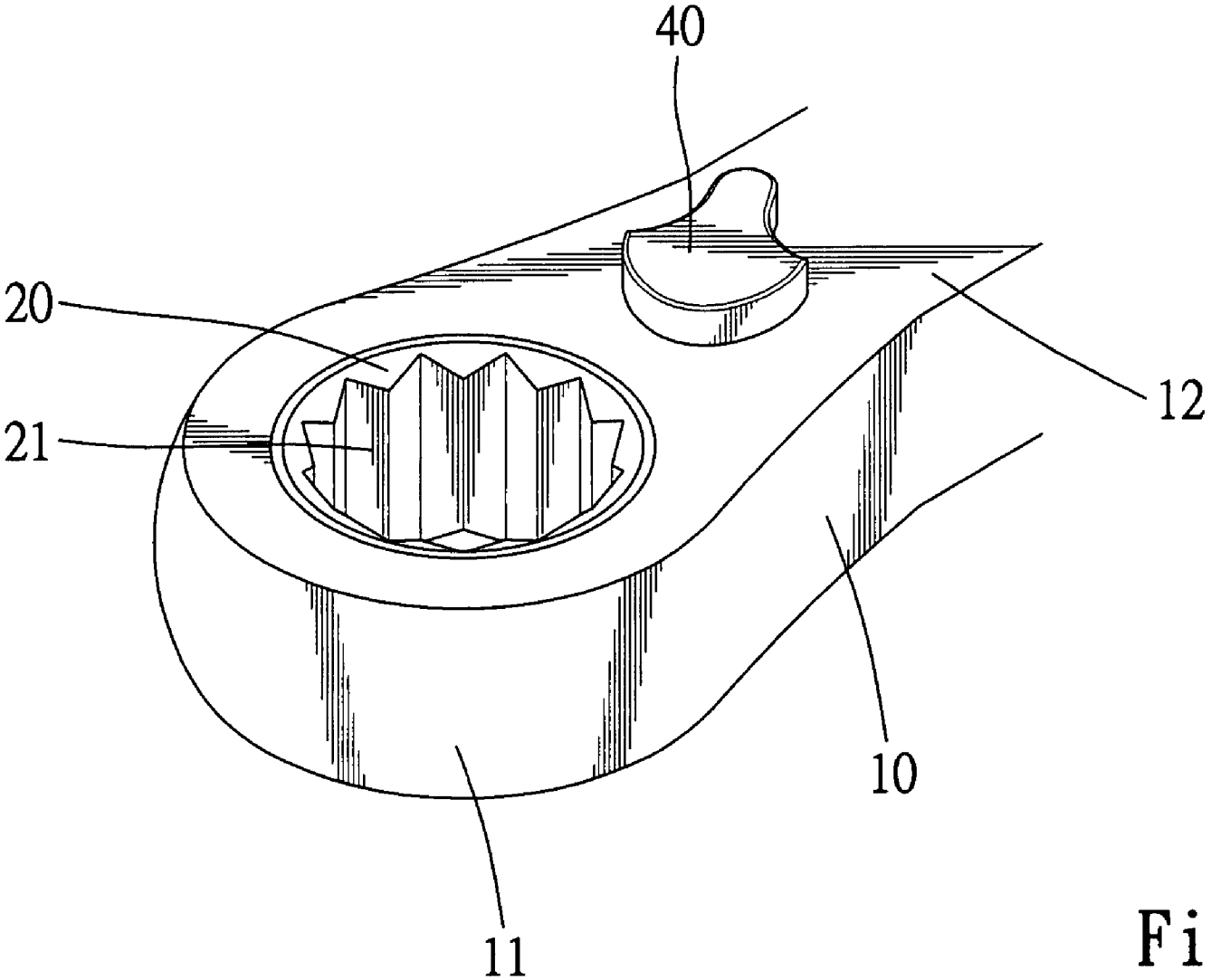
FIG. 1 is a perspective view of a compact wrench in accordance with the present invention.
Figure 2:
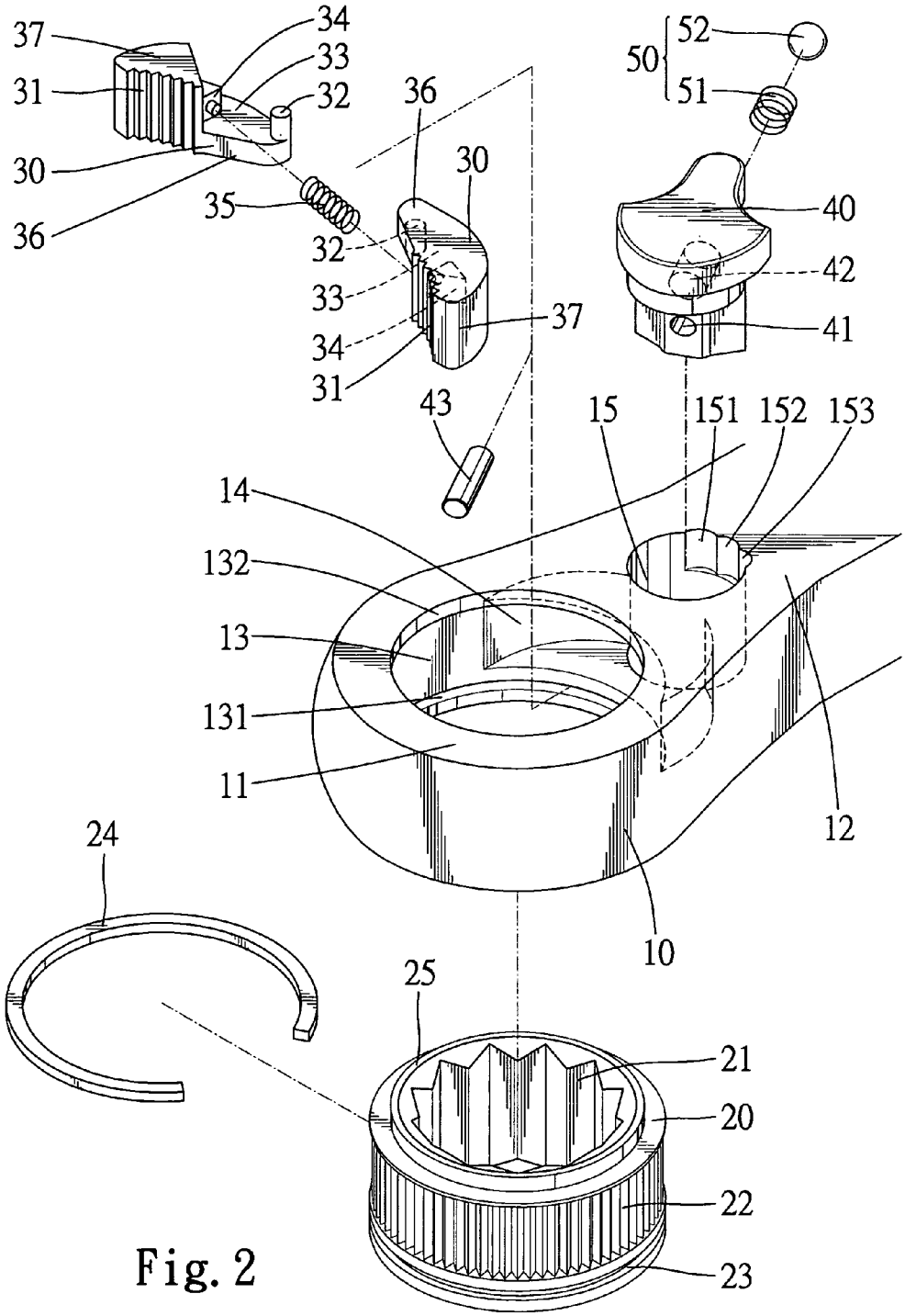
FIG. 2 is an exploded perspective view of the compact wrench in accordance with the present invention.
Figure 3:
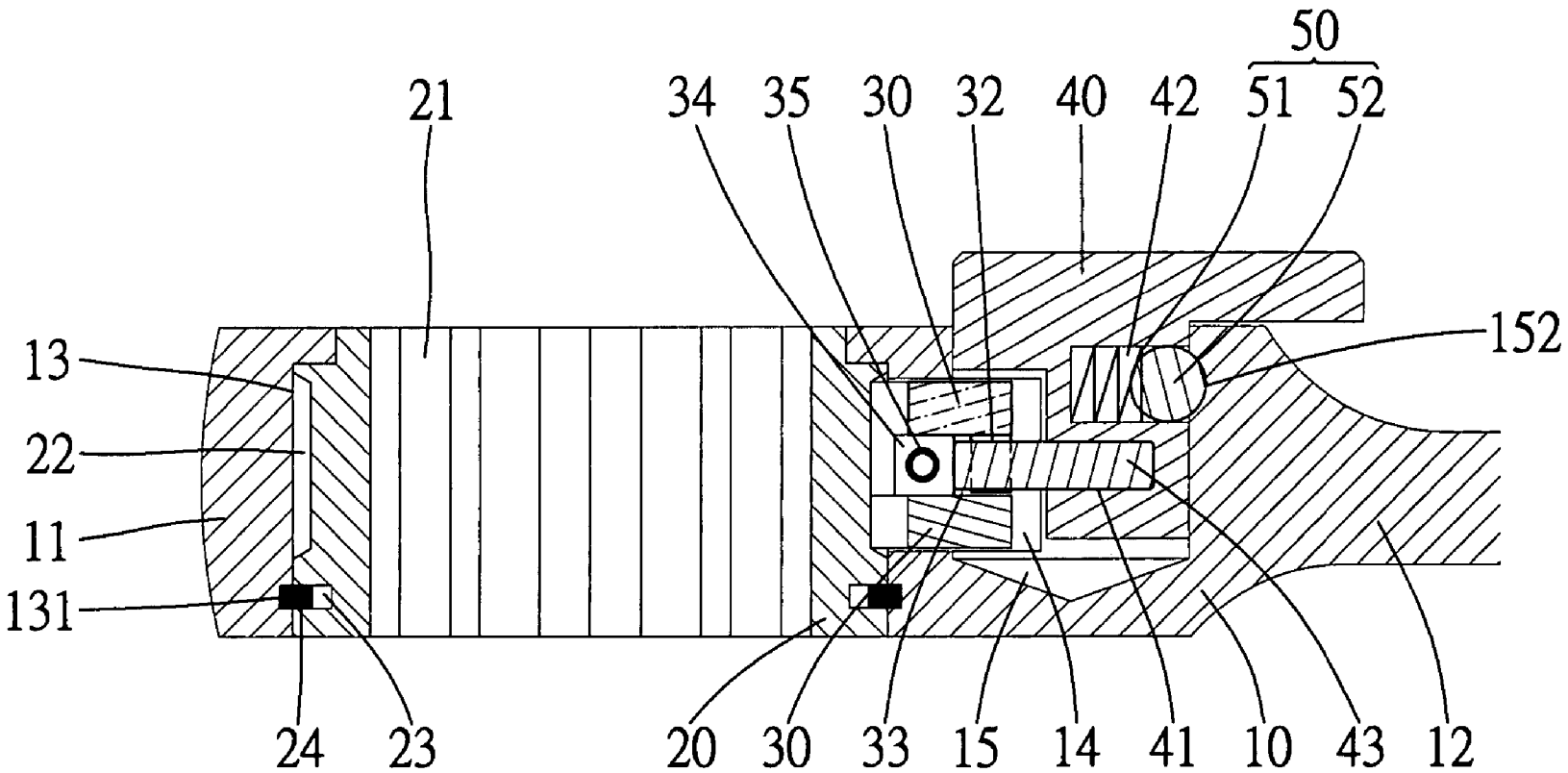
FIG. 3 is a sectional view of the compact wrench in accordance with the present invention.

Referring to FIGS. 1 through 4, a compact wrench 10 in accordance with the present invention comprises a handle 12 and a head 11 formed on an end of the handle 12. The head 11 includes a compartment 13 that is substantially circular, with a flange 132 formed on an end of an inner periphery delimiting the compartment 13 and with an annular groove 131 defined in the other end of the inner periphery delimiting the compartment 13. The handle 12 includes a hole 15 for pivotably receiving a switch 40. A cavity 14 is defined in the inner periphery delimiting the compartment 13 and communicates with the hole 15.

A drive member 20 is rotatably mounted in the compartment 13 of the head 11. In this embodiment, the drive member 20 includes a plurality of teeth 22 in an outer periphery thereof and a polygonal inner periphery 21. A retaining portion is formed on an end of the drive member 20 and a shoulder 25 is formed on the other end of the drive member 20. In this embodiment, the retaining portion is an annular groove 23. A c-clip 24 is partially received in the annular groove 23 of the drive member 20 and partially received in the annular groove 131 of the head 11, allowing rotation of the drive member 20 in the compartment 13. The flange 131 of the head 11 holds the shoulder 26 of the drive member 20 to prevent disengagement of the drive member 20 from the compartment 13 while allowing rotation of the drive member 20.

Figure 4:
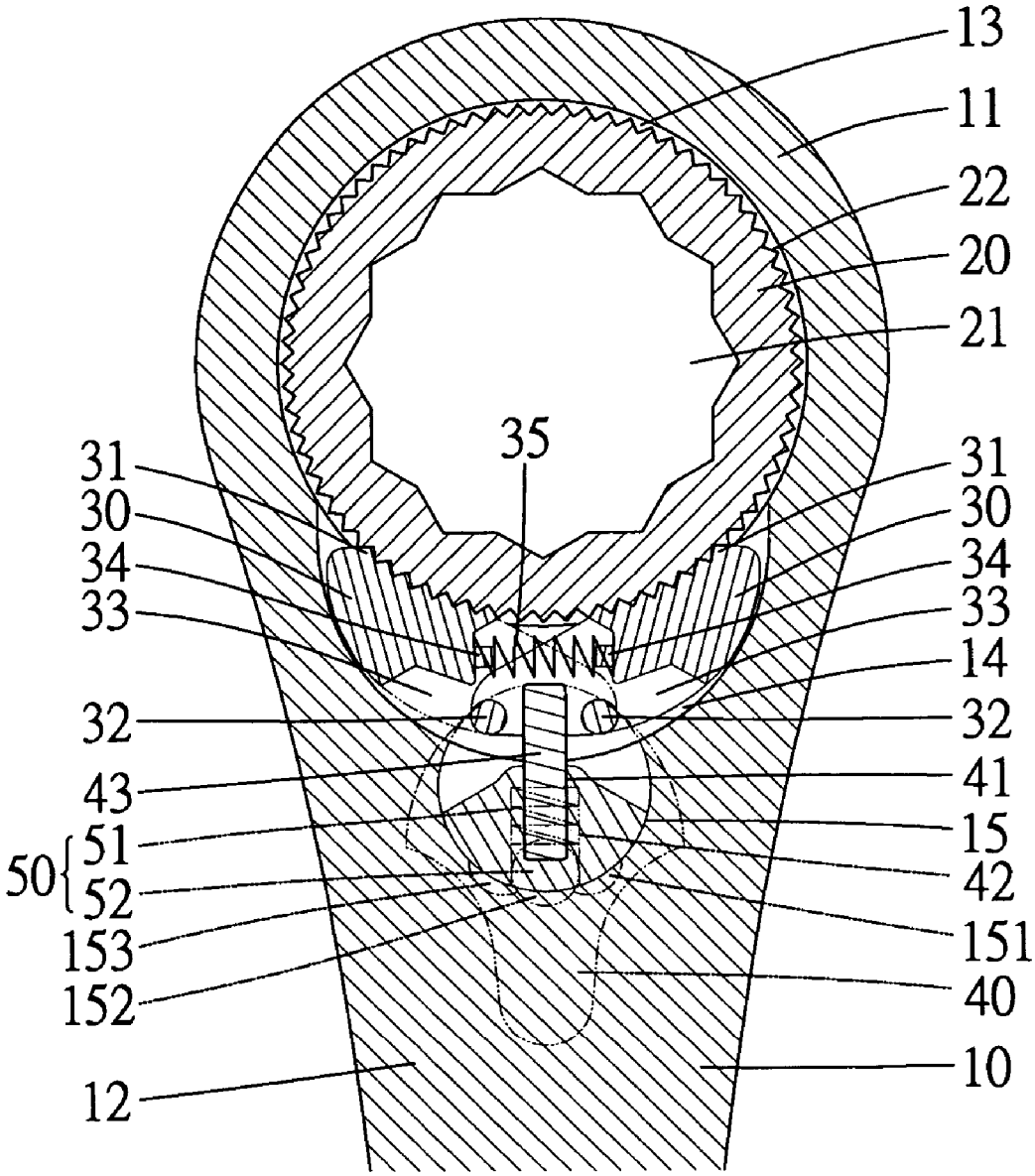
FIG. 4 is another sectional view of the compact wrench in accordance with the present invention, wherein the compact wrench is in a state allowing driving rotation in either direction.

Two pawls 30 are slidably mounted in the cavity 14. In the illustrated embodiment, each pawl 30 includes a first end in the form of a block 37. The block 37 of each pawl 30 includes a plurality of teeth 31 on a side thereof that faces the drive member 20. One of the pawls 30 (the left one in FIG. 2) includes a second end in the form of a platform 36 extending from a lower end of a side of the block 37, defining an upward facing space 33. The other pawl 30 (the right one in FIG. 2) includes a second end in the form of a platform 36 extending from an upper end of a side of the block 37, defining a downward facing space 33. A protrusion 32 is formed on each platform 36. Further, an elastic element-abutting portion 34 is formed on the platform 36 of each pawl 30. Referring to FIG. 4, the pawls 30 are mounted in the cavity 14, with the platforms 36 of the pawls 30 facing each other and spaced from each other, with the spaces 33 of the pawls 30 overlapping with each other, and with the protrusion 32 of each pawl 30 being located in the space 33 of the other pawl 30. An elastic element 35 is mounted in the overlapped spaces 33 of the pawls 30 and includes two ends respectively abutting against the elastic element-abutting portions 34 of the pawls 30.

The switch member 40 received in the hole 15 of the handle 12 is pivotable between three positions. In this embodiment, the switch member 40 includes a hole 41 facing the cavity 14 and a receptacle 42 facing away from the cavity 14. An actuating member 43 includes an end fixed in the hole 41 of the switching member 40, with the other end of the actuating member 43 extending into the overlapped space 33 of the pawls 30 and between the protrusions 32. An inner periphery delimiting the hole 15 includes three retaining sections 151, 152, and 153 facing the cavity 14. Preferably, the retaining sections 151, 152, and 153 are recessed and arcuate. A positioning means 50 is provided for positioning the switch 40 in one of the three positions. In this embodiment, the positioning means 50 includes a ball 52 mounted in the receptacle 42 and an elastic element 51 in the receptacle 42 for biasing the ball 52 partially out of the receptacle 42 to selectively engage with one of the retaining sections 151, 152, and 153.

Referring to FIG. 4, when the switch member 40 is in its central position, the ball 52 is retained in the second retaining section 152. The actuating member 43 is in a position between the protrusions 32 of the pawls 30, both of the pawls 30 are biased by the elastic element 35 to engage with the teeth 22 of the drive member 20. Further, both of the pawls 30 abut against two sidewall portions delimiting the cavity 14. Thus, the compact wrench in FIG. 4 is in a state allowing driving rotation for driving a faster in either direction.

Figure 5:
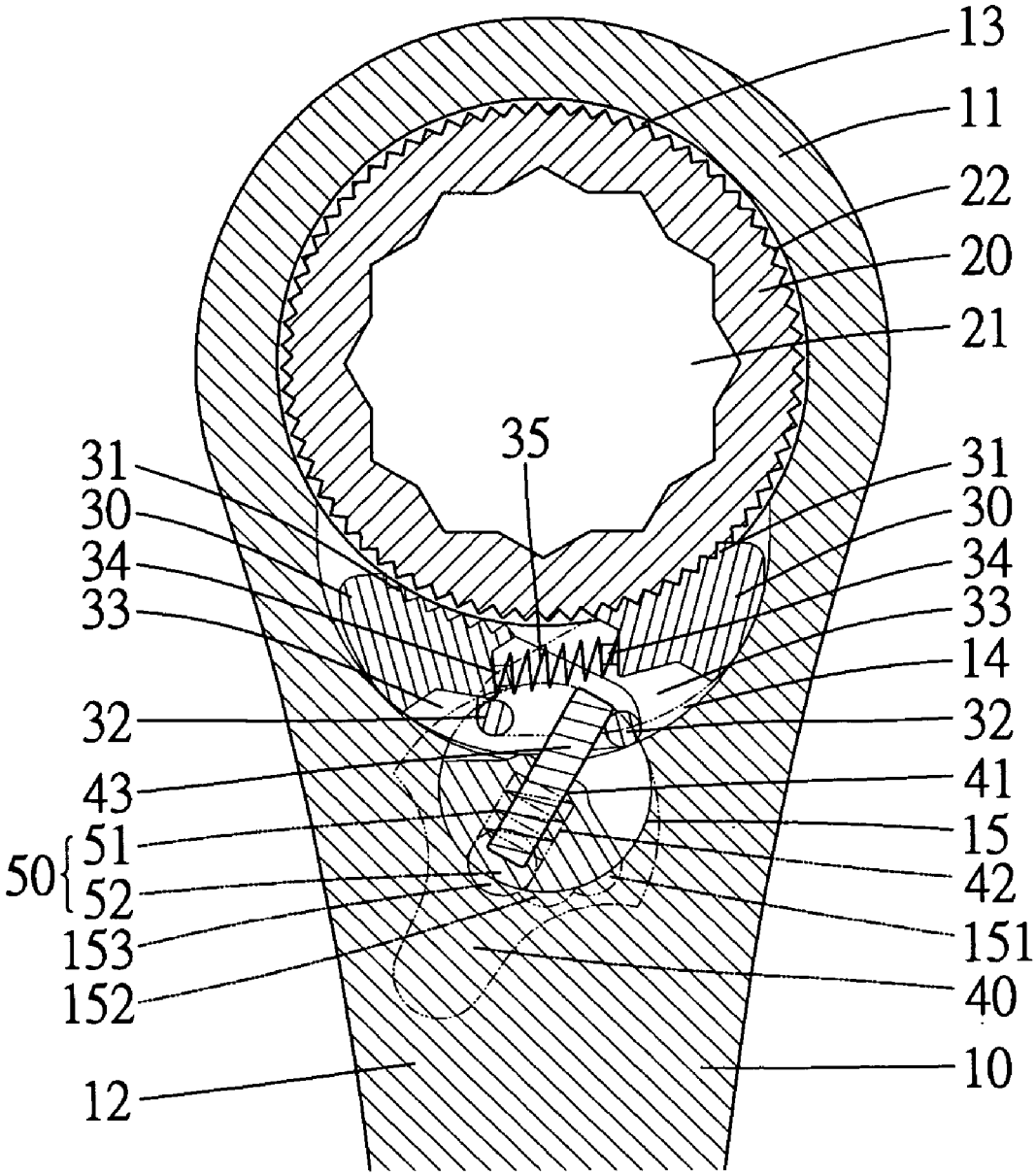
FIG. 5 is a sectional view similar to FIG. 4, wherein the compact wrench is in a state allowing counterclockwise driving rotation and clockwise free rotation.

When the switch 40 is pivoted, e.g., clockwise to a position shown in FIG. 5, the ball 52 is retained in the third retaining section 153. During movement of the actuating member 43, the protrusion 32 (the right one in FIG. 5) of an associated one of the pawls 30 (the left one in FIG. 5) is pressed against and thus moved by the actuating member 43, disengaging the left pawl 30 from the drive member 20 while the right pawl 30 remains still. Thus, the compact wrench in FIG. 5 is in a state allowing counterclockwise driving rotation for driving a fastener and clockwise free rotation not driving the fastener. It is noted that the overlapped spaces 33 of the pawls 30 allow free movement of the left pawl 30 and its protrusion 32.

Figure 6:
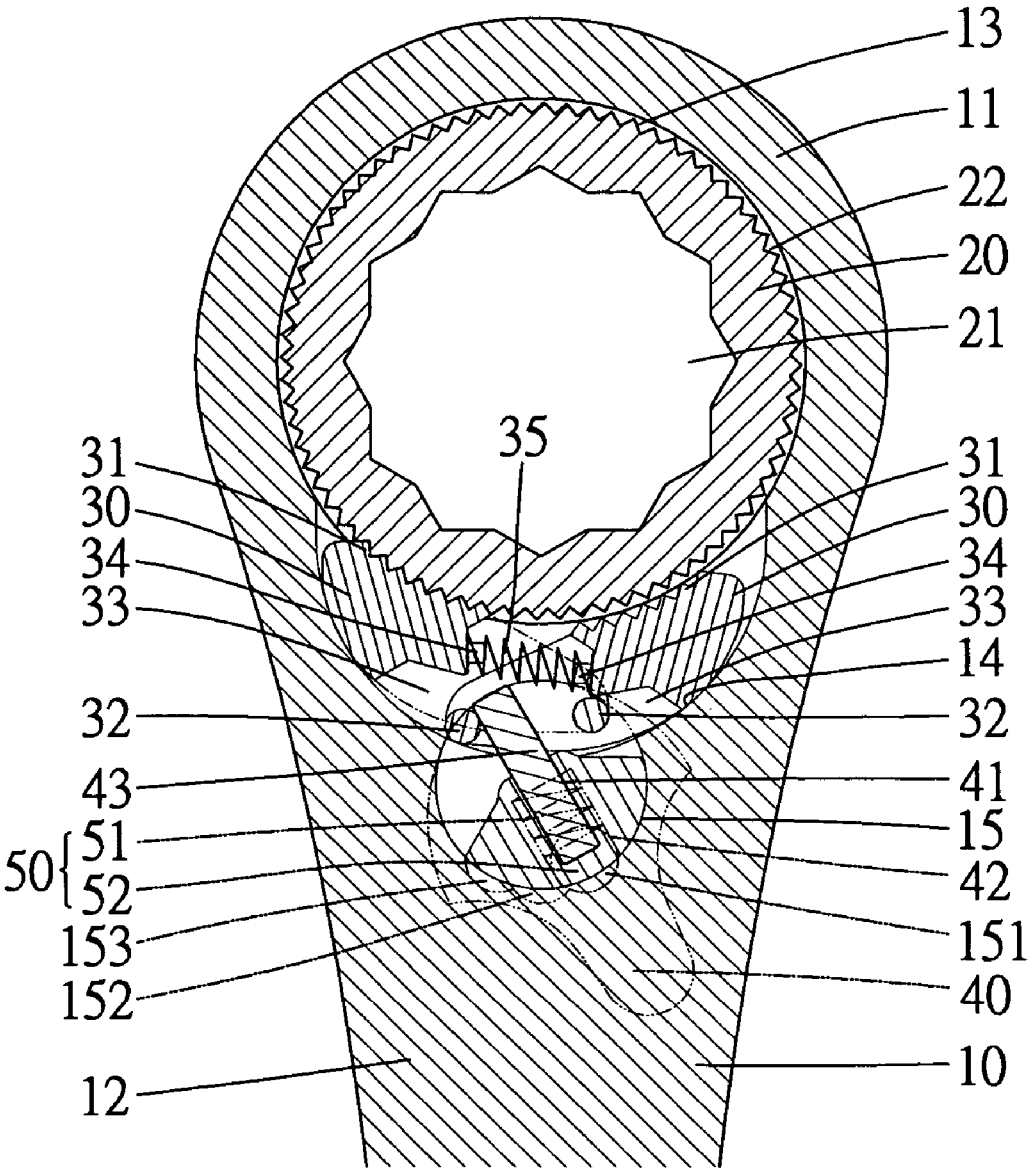
FIG. 6 is a sectional view similar to FIG. 4, wherein the compact wrench is in a state allowing clockwise driving rotation and counterclockwise free rotation.

When the switch 40 is pivoted counterclockwise from a position shown in FIG. 4 to a position shown in FIG. 6, the ball 52 is retained in the first retaining section 151. During movement of the actuating member 43, the protrusion 32 (the left one in FIG. 6) of the other pawl 30 (the right one in FIG. 6) is pressed against and thus moved by the actuating member 43, disengaging the right pawl 30 from the drive member 20 while the left pawl 30 remains still. Thus, the compact wrench in FIG. 6 is in a state allowing clockwise driving rotation for driving a fastener and counterclockwise free rotation not driving the fastener. It is noted that the overlapped spaces 33 of the pawls 30 allow free movement of the right pawl 30 and its protrusion 32.

Since the protrusion 32 of each pawl 30 is located in the space 33 of the other pawl 30, this alternate arrangement makes the distance between the protrusions 32 of the pawls 30 smaller while allowing the actuating member 43 to urge the desired pawl 30 to disengage from the drive member 20 at a small angular travel of the actuating member 43. The size of the head 11 of the wrench can be smaller than that of the conventional design. A compact wrench is thus provided. Further, the simple design of the actuating member 43 has a small thickness and thus increases the wall thickness that delimits the cavity 14.

Figure 7:
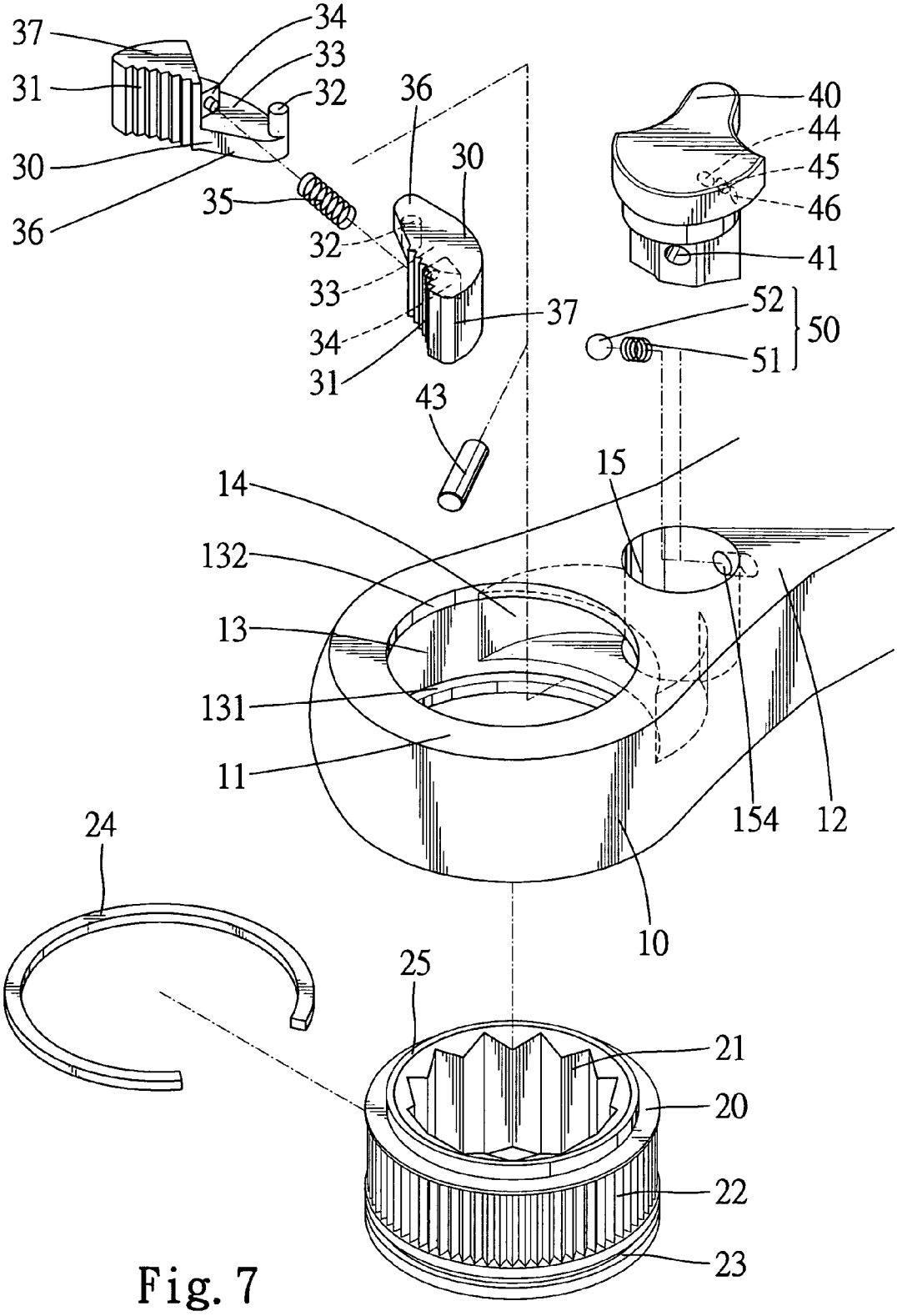
FIG. 7 is an exploded perspective view illustrating a modified embodiment of the compact wrench in accordance with the present invention.
Figure 8:
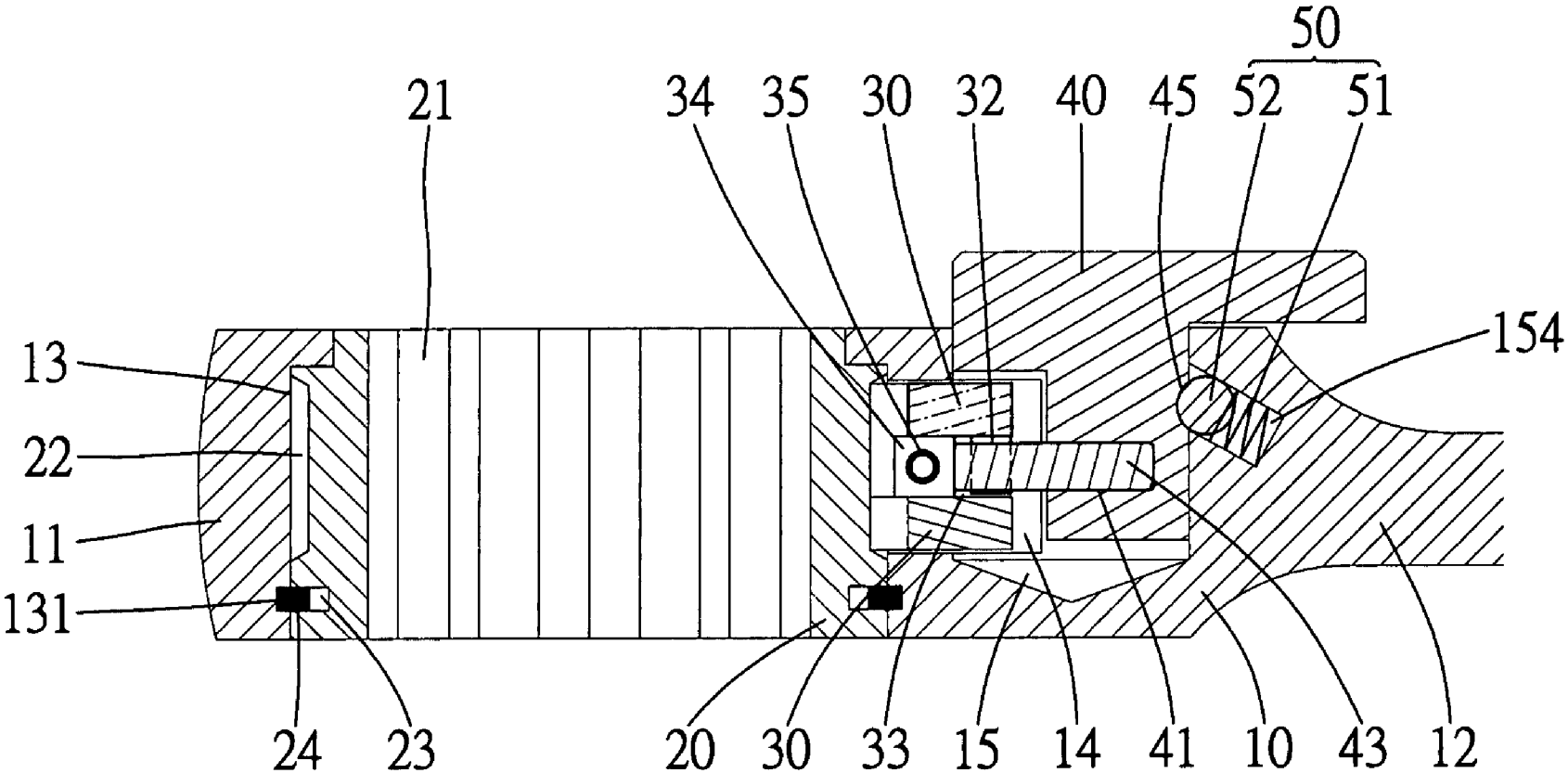
FIG. 8 is a sectional view of the compact wrench in FIG. 7.

FIGS. 7 and 8 illustrate a second embodiment of the invention. In this embodiment, a receptacle 154 is defined in an inner periphery delimiting the hole 15. The positioning means 50 includes a ball 52 mounted in the receptacle 154 and an elastic element 51 in the receptacle 154 for biasing the ball 52 partially out of the receptacle 154 to selectively engage with one of the three retaining sections 44, 45, and 46 on the switch 40. In this embodiment, each of the retaining sections 44, 45, and 46 of the switch 40 is a recessed portion.

Figure 9:
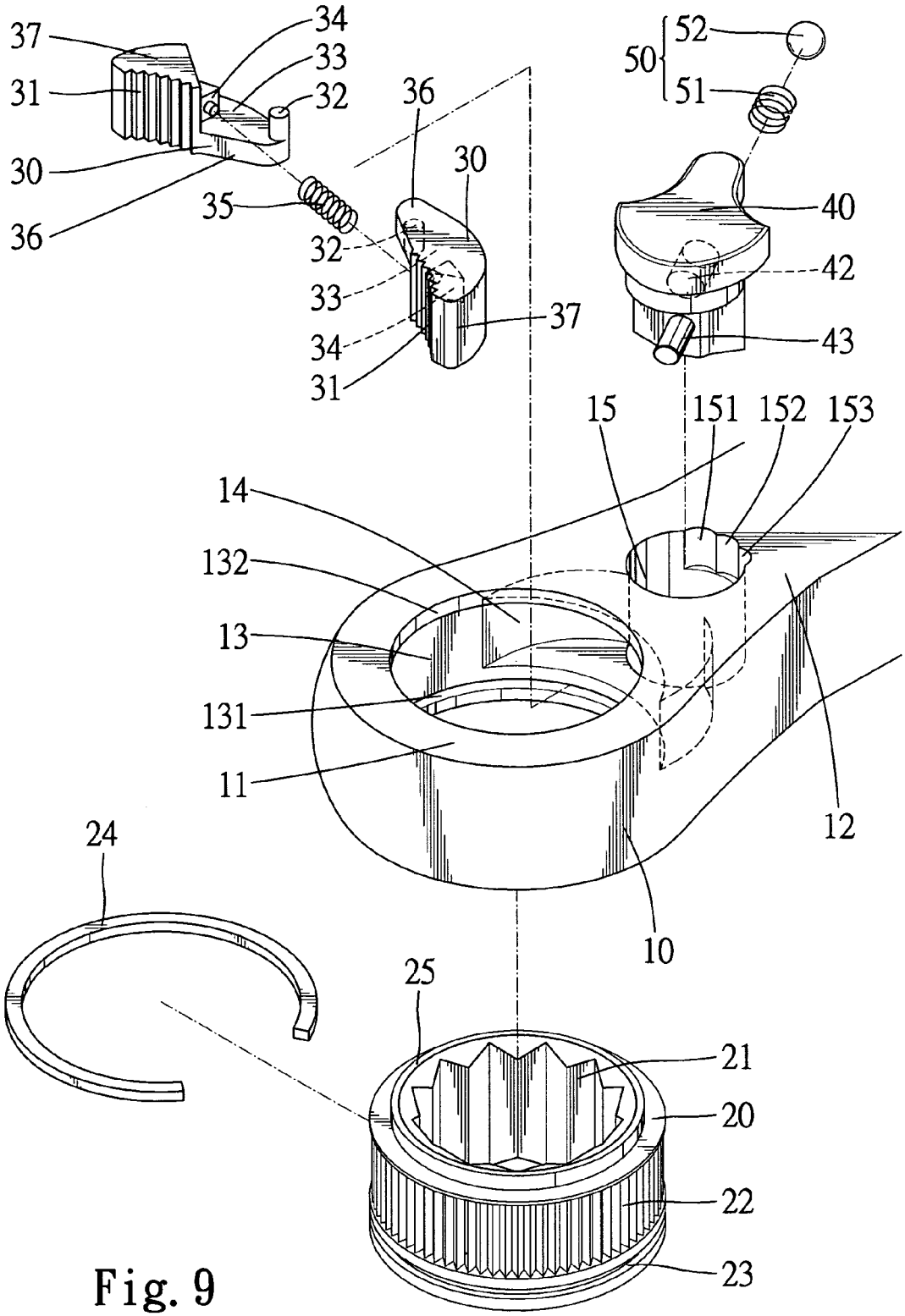
FIG. 9 is an exploded perspective view illustrating another modified embodiment of the compact wrench in accordance with the present invention.
Figure 10:
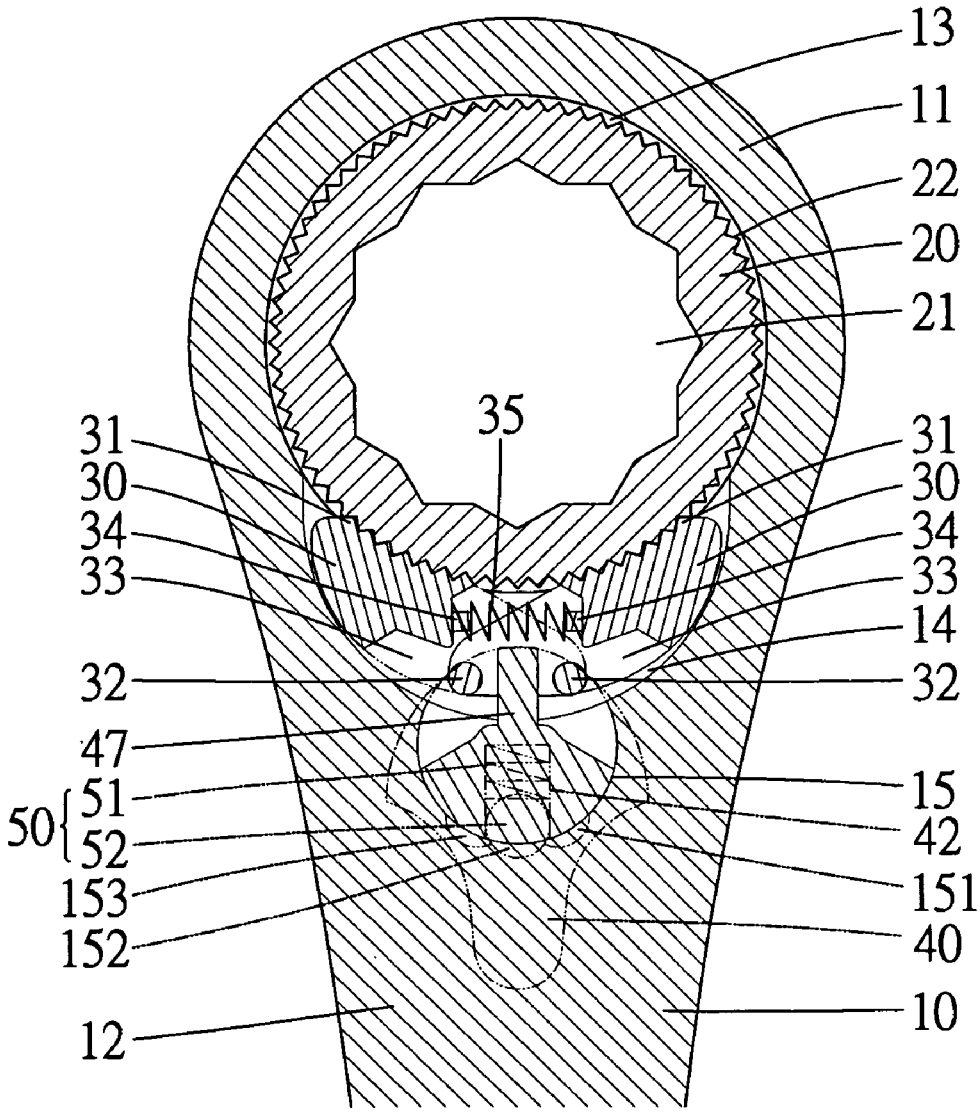
FIG. 10 is a sectional view of the compact wrench in FIG. 9.
Figure 11:
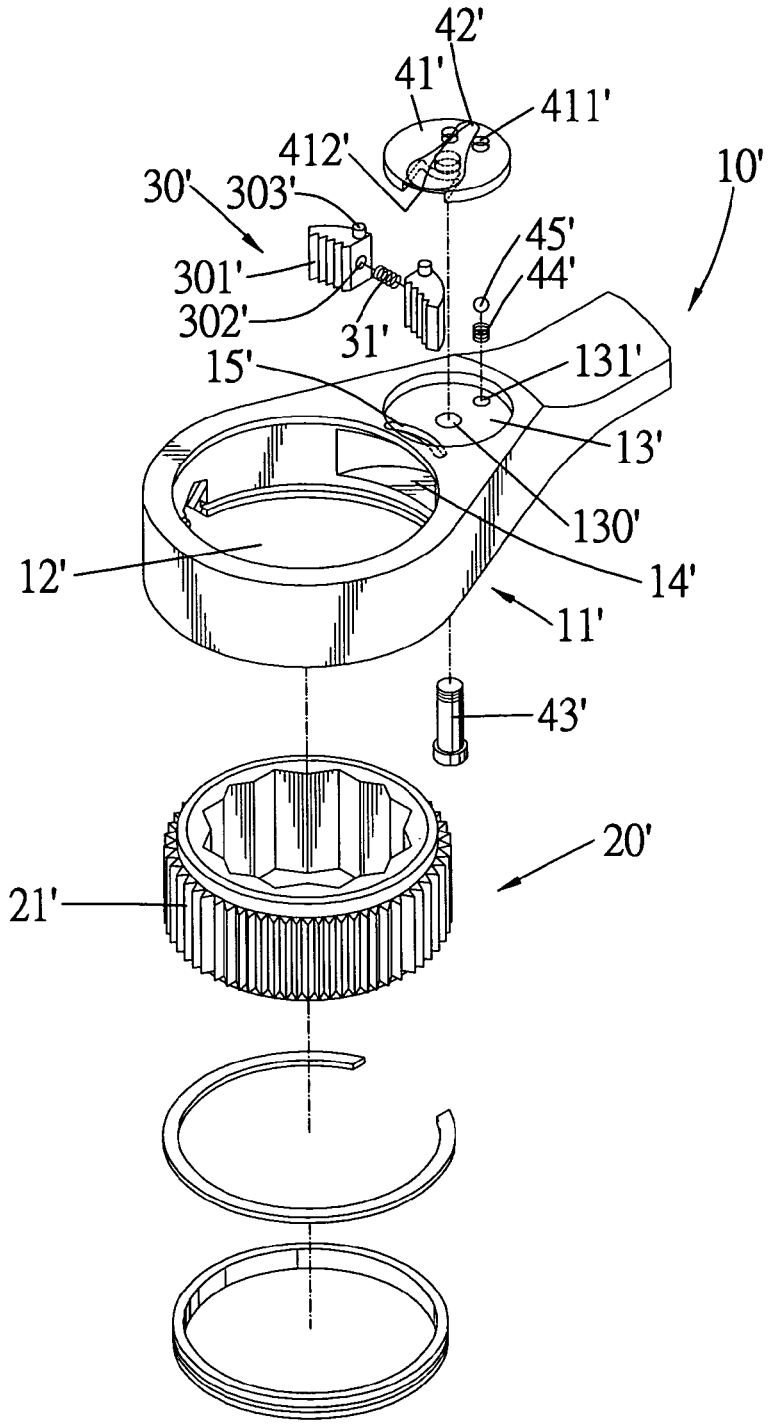
Fig. 11 PRIOR ART
FIG. 11 is an exploded perspective view of a conventional wrench.

FIGS. 9 and 10 illustrate an embodiment modified from the first embodiment, wherein the actuating member 43 is integrally formed with the switching member 40 and the hole 41 in the switch member 40 is omitted.

Although specific embodiments have been illustrated and described, numerous modifications and variations are still possible without departing from the essence of the invention. The scope of the invention is limited by the accompanying claims.

What is claimed is:

1. A wrench comprising:

a handle including an end, the handle further including a hole defined in a side thereof;

a head formed on the end of the handle, the head including a compartment, a cavity being defined in an inner periphery delimiting the compartment and communicating with the hole of the handle;

a drive member rotatably mounted in the compartment, the drive member including a plurality of teeth in an outer periphery thereof;

two pawls slidably mounted in the cavity, each said pawl including a first end and a second end, the first end of each said pawl including a plurality of teeth in a side thereof for disengageably engaging with the teeth of the drive member, the second end of each said pawl defining a space, the second end of each said pawl further including a protrusion, the pawls being so mounted that the spaces of the pawls overlap with each other and that the protrusion of each said pawl is located in the space of the other pawl;

an elastic element mounted between the pawls for biasing the teeth of each said pawl to engage with the teeth of the drive member; and a switch pivotally mounted in the hole of the handle, the switch including an actuating member extending into the overlapped spaces of the pawls and between the protrusions of the pawls, the actuating member of the switch being pivotable to engage with and thus move the protrusion of one of the pawls, disengaging the teeth of said one of the pawls from the teeth of the drive member and thereby changing a driving rotation direction and a free rotation direction of the wrench.

2. The wrench as claimed in claim 1, with the switch being pivotable between three positions, with the wrench further including means for retaining the switch in one of the three positions.

3. The wrench as claimed in claim 1, with an inner periphery delimiting the hole of the handle including three retaining sections, with the wrench further including means for retaining the switch in one of the three retaining sections.

4. The wrench as claimed in claim 3, with the switch including a receptacle, with a ball being received in the receptacle of the switch, and an elastic element for biasing the ball to engage with one of the three retaining sections.

5. The wrench as claimed in claim 4, with one of the pawls being disengaged from the drive member and the other pawl being engaged with the drive member when the switch is in a first one of the three retaining sections, allowing clockwise driving rotation and counterclockwise free rotation of the wrench, with both of the pawls being engaged with the drive member when the switch in a second one of the three retaining sections, allowing driving rotation of the wrench in either direction, and with said one of the pawls being engaged with the drive member and the other pawl being disengaged from the drive member when the switch is in a third one of the three retaining sections, allowing counterclockwise driving rotation and clockwise free rotation of the wrench.

6. The wrench as claimed in claim 1, with the outer periphery of the drive member further including an annular groove, with the inner periphery delimiting the compartment including an annular groove, and with a C-clip partially received in the annular groove of the drive member and partially received in the annular groove of the compartment.

7. The wrench as claimed in claim 1, with the outer periphery of the drive member including a shoulder, with the inner periphery delimiting the compartment including a flange for rotatably holding the shoulder.

8. The wrench as claimed in claim 1 with the switch including a hole for securely receiving an end of the actuating member.

9. The wrench as claimed in claim 1, with the switch including three retaining sections, with the wrench further including means for retaining the switch in one of the three retaining sections.

10. The wrench as claimed in claim 9, with an inner periphery delimiting the hole of the handle including a receptacle, with a ball being received in the receptacle of the handle, and an elastic element for biasing the ball to engage with one of the three retaining sections.

11. The wrench as claimed in claim 10, with one of the pawls being disengaged from the drive member and the other pawl being engaged with the drive member when the switch is in a first one of the three retaining sections, allowing clockwise driving rotation and counterclockwise free rotation of the wrench, with both of the pawls being engaged with the drive member when the switch in a second one of the three retaining sections, allowing driving rotation of the wrench in either direction, and with said one of the pawls being engaged with the drive member and the other pawl being disengaged from the drive member when the switch is in a third one of the three retaining sections, allowing counterclockwise driving rotation and clockwise free rotation of the wrench.

12. The wrench as claimed in claim 1, with each said pawl including a block and a platform extending from an end of a side of the block.

13. The wrench as claimed in claim 12, with the platform of one of the pawls extending from a lower end of the block of said one of the pawls, defining an upward facing space, and with the platform of the other pawl extending from an upper end of the side of the block of the other pawl, defining a downward facing space.

14. The wrench as claimed in claim 13, with the platforms facing each other and being spaced from each other by the overlapped space of the pawls.

15. The wrench as claimed in claim 1, with the switch being pivotable between three positions, with one of the pawls being disengaged from the drive member and the other pawl being engaged with the drive member when the switch is in a first one of the three positions, allowing clockwise driving rotation and counterclockwise free rotation of the wrench, with both of the pawls being engaged with the drive member when the switch in a second one of the three positions, allowing driving rotation of the wrench in either direction, and with said one of the pawls being engaged with the drive member and the other pawl being disengaged from the drive member when the switch is in a third one of the three positions, allowing counterclockwise driving rotation and clockwise free rotation of the wrench.

16. The wrench as claimed in claim 1, with the switch and the actuating member being integrally formed with each other.

17. A wrench comprising:

a handle including an end, the handle further including a hole defined in a side thereof;

a head formed on the end of the handle, the head including a compartment, a cavity being defined in an inner periphery delimiting the compartment and communicating with the hole of the handle;

a drive member rotatably mounted in the compartment;

two pawls slidably mounted in the cavity, each said pawl including an end defining a space, the end of each said pawl further including a protrusion, the pawls being so mounted that the spaces of the pawls overlap with each other and that the protrusion of each said pawl is located in the space of the other pawl;

an elastic element for biasing at least one of the pawls to engage with the drive member; and a switch pivotally mounted in the hole of the handle, the switch including an actuating member extending into the overlapped spaces of the pawls and between the protrusions of the pawls, the actuating member of the switch being pivotable to engage with and thus move the protrusion of one of the pawls, disengaging said one of the pawls from the drive member and thereby changing a driving rotation direction and a free rotation direction of the wrench.

18. The wrench as claimed in claim 17, with the switch being pivotable between three positions, with the wrench further including means for retaining the switch in one of the three positions.

19. The wrench as claimed in claim 17, with an inner periphery delimiting the hole of the handle including three retaining sections, with the wrench further including means for retaining the switch in one of the three retaining sections.

20. The wrench as claimed in claim 19, with the switch including a receptacle, with a ball being received in the receptacle of the switch, and an elastic element for biasing the ball to engage with one of the three retaining sections.

21. The wrench as claimed in claim 20, with one of the pawls being disengaged from the drive member and the other pawl being engaged with the drive member when the switch is in a first one of the three retaining sections, allowing clockwise driving rotation and counterclockwise free rotation of the wrench, with both of the pawls being engaged with the drive member when the switch in a second one of the three retaining sections, allowing driving rotation of the wrench in either direction, and with said one of the pawls being engaged with the drive member and the other pawl being disengaged from the drive member when the switch is in a third one of the three retaining sections, allowing counterclockwise driving rotation and clockwise free rotation of the wrench.

22. The wrench as claimed in claim 17, with the switch including three retaining sections, with the wrench further including means for retaining the switch in one of the three retaining sections.

23. The wrench as claimed in claim 22, with an inner periphery delimiting the hole of the handle including a receptacle, with a ball being received in the receptacle of the handle, and an elastic element for biasing the ball to engage with one of the three retaining sections.

24. The wrench as claimed in claim 23, with one of the pawls being disengaged from the drive member and the other pawl being engaged with the drive member when the switch is in a first one of the three retaining sections, allowing clockwise driving rotation and counterclockwise free rotation of the wrench, with both of the pawls being engaged with the drive member when the switch in a second one of the three retaining sections, allowing driving rotation of the wrench in either direction, and with said one of the pawls being engaged with the drive member and the other pawl being disengaged from the drive member when the switch is in a third one of the three retaining sections, allowing counterclockwise driving rotation and clockwise free rotation of the wrench.

25. The wrench as claimed in claim 17, with each said pawl including a block and a platform extending from an end of a side of the block.

26. The wrench as claimed in claim 25, with the platform of one of the pawls extending from a lower end of the block of said one of the pawls, defining an upward facing space, and with the platform of the other pawl extending from an upper end of the side of the block of the other pawl, defining a downward facing space.

27. The wrench as claimed in claim 26, with the platforms facing each other and being spaced from each other by the overlapped space of the pawls.

28. The wrench as claimed in claim 17, with the switch being pivotable between three positions, with one of the pawls being disengaged from the drive member and the other pawl being engaged with the drive member when the switch is in a first one of the three positions, allowing clockwise driving rotation and counterclockwise free rotation of the wrench, with both of the pawls being engaged with the drive member when the switch in a second one of the three positions, allowing driving rotation of the wrench in either direction, and with said one of the pawls being engaged with the drive member and the other pawl being disengaged from the drive member when the switch is in a third one of the three positions, allowing counterclockwise driving rotation and clockwise free rotation of the wrench.

29. The wrench as claimed in claim 17, with the switch and the actuating member being integrally formed with each other.

30. A wrench comprising:

a handle including an end, the handle further including a hole defined in a side thereof;

a head formed on the end of the handle, the head including a compartment, a cavity being defined in an inner periphery delimiting the compartment and communicating with the hole of the handle;

a drive member rotatably mounted in the compartment;

two pawls slidably mounted in the cavity;

an elastic element for biasing at least one of the pawls to engage with the drive member; and a switch mounted in the hole of the handle and pivotable between three positions, the switch including an actuating member for urging a selected one of the pawls to disengage from the drive member, thereby changing a driving rotation direction and a free rotation direction of the wrench;

wherein one of the pawls is disengaged from the drive member and the other pawl is engaged with the drive member when the switch is in a first one of the three positions, allowing clockwise driving rotation and counterclockwise free rotation of the wrench;

wherein both of the pawls are engaged with the drive member when the switch in a second one of the three positions, allowing driving rotation of the wrench in either direction; and wherein said one of the pawls is engaged with the drive member and the other pawl is disengaged from the drive member when the switch is in a third one of the three positions, allowing counterclockwise driving rotation and clockwise free rotation of the wrench.

31. The wrench as claimed in claim 30, with the wrench further including means for retaining the switch in one of the three positions.

32. The wrench as claimed in claim 30, with an inner periphery delimiting the hole of the handle including three retaining sections, with the wrench further including means for retaining the switch in one of the three retaining sections.

33. The wrench as claimed in claim 32, with the switch including a receptacle, with a ball being received in the receptacle of the switch, and an elastic element for biasing the ball to engage with one of the three retaining sections.

34. The wrench as claimed in claim 30, with the switch including three retaining sections, with the wrench further including means for retaining the switch in one of the three retaining sections.

35. The wrench as claimed in claim 34, with an inner periphery delimiting the hole of the handle including a receptacle, with a ball being received in the receptacle of the handle, and an elastic element for biasing the ball to engage with one of the three retaining sections.

* * * * *